United States Patent [19]

Manley

[11] 4,023,674

[45] May 17, 1977

[54] JEWELRY BOX

[76] Inventor: Patricia A. Manley, 1230 E. Ravine Drive, Zion, Ill. 60099

[22] Filed: Nov. 14, 1975

[21] Appl. No.: 631,853

[52] U.S. Cl. ..... 206/562; D87/1 B; 206/458; 206/566

[51] Int. Cl.[2] ..... B65D 1/34; B65D 73/00

[58] Field of Search ..... 206/457, 458, 75; D87/1 B

[56] References Cited

UNITED STATES PATENTS

| | | | |
|---|---|---|---|
| 387,466 | 8/1888 | Watson | 206/457 |
| 1,528,229 | 3/1925 | Wetherell | 206/75 |
| D49,514 | 8/1916 | Hadley et al. | D87/1 B |

*Primary Examiner*—George E. Lowrance

*Assistant Examiner*—Douglas B. Farrow

*Attorney, Agent, or Firm*—Fitch, Even, Tabin & Luedeka

[57] ABSTRACT

A jewelry box is disclosed for holding a necklace or the like therein, which has a removable lid with two apertures through which the posts of a pair of earrings can be placed, with the earring clasps being attached to the posts on the underside of the lid. The decorative portion of the earrings are preferably in the form of flowers which greatly enhance the appearance of the jewelry box when the earrings are attached thereto. The earrings can be easily removed and worn if desired. Indicia on the upper surface of the lid may provide the outline of leaves and stem for the decorative flower portion of the earrings.

5 Claims, 6 Drawing Figures

JEWELRY BOX

The present invention generally relates to containers and, more specifically, to small containers or boxes for holding jewelry or the like.

The countless variations in the shape, size, interior as well as exterior design of jewelry boxes and other small decorative containers is readily apparent. The detail and intricacy of the artistic design of such containers can also vary over a virtually unlimited range. Indeed, there are some jewelry boxes which, because of the exquisite artwork and choice of material from which they are made, can be extraordinarily valuable.

That the material from which such containers and jewelry boxes are made is a function of the times in which we live is evidenced by the increasing use of new plastics and other unique materials, as well as a more enlightened realization of the unique application of other materials that have been known and available for some time.

Accordingly, it is an object of the present invention to provide a unique jewelry box in combination with a pair of earrings, the combination of the components being particularly unique and appealing.

Other objects and advantages will become apparent upon reading the following detailed description, while referring to the attached drawings, in which.

Figure 1:
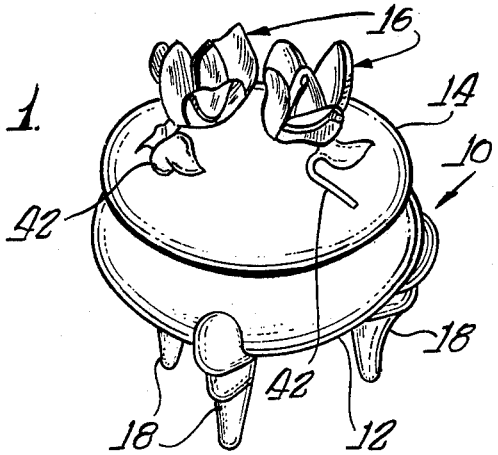
FIG. 1 is a perspective view of a jewelry box and earrings embodying the present invention.
Figure 2:
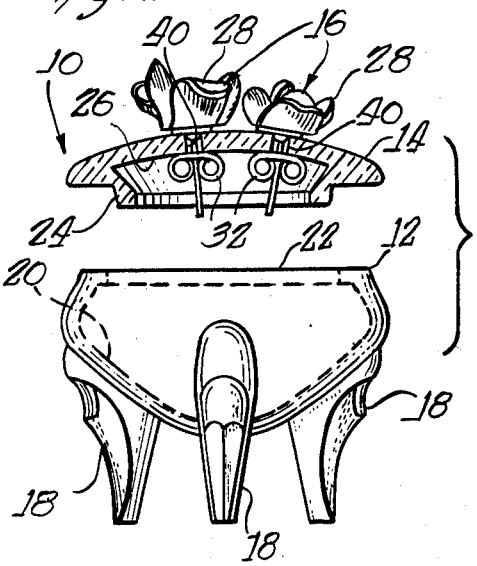
FIG. 2 is a side elevation with portions shown in cross-section of the jewelry box and earrings shown in FIG. 1.
Figure 3:
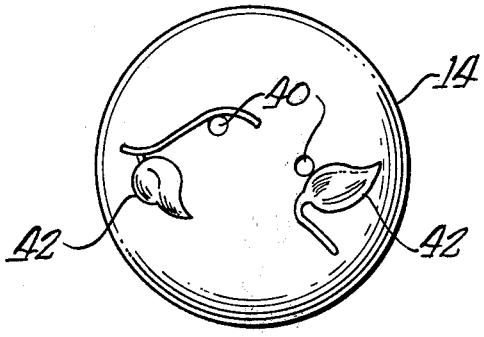
FIG. 3 is a top plan view of the lid of the jewelry box shown in FIGS. 1 and 2.

Turning now to the drawings, a jewelry box, indicated generally at 10, includes a base 12 as well as a removable lid 14 with the lid carrying a pair of earrings, indicated generally at 16 as best shown in FIGS. 1 and 2. The base 12 has three downwardly extending legs 18 which are preferably integrally formed with the remainder of the base. Although the embodiment shown in the drawings has three legs 18, it should be appreciated that the base may be made to have four or more legs or it may not have any legs at all. The interior of the base has a cavity 20 in which to hold a necklace or the like therein and the cavity may be provided with a thin layer of foam rubber or other soft material to provide a cushioning as well as a decorative effect. The upper surface 22 of the base is preferably flat and the interior or cavity 20 preferably corresponds to the exterior shape so that the sidewalls of the base are not exceedingly thick. In the embodiment illustrated in the drawings, the top surface 22 of the base is substantially circular. It should be appreciated that in the event a rectangular or square base is utilized, there would probably be four legs 18 and the interior cavity would accordingly be generally rectangular or square shaped.

The configuration of the lid 14 is preferably such that it will cooperatively engage the walls adjacent the cavity 20 of the base to cause some resistance to lateral movement of the lid relative to the base, i.e., the lid will nicely fit over the top surface 22 of the base when it is placed in the position shown in FIG. 1. In this regard, it is preferred that the lid have a downwardly extending annular flange 24 that will fit within the cavity 20 and thereby tend to prevent sliding lateral movement between the two. As best shown in FIG. 2, a lid 14 has a central hollow portion 26 rather than being solid throughout.

Figure 4:
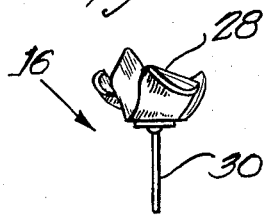
FIG. 4 is a plan view of a single earring shown without the clasp.
Figure 5:
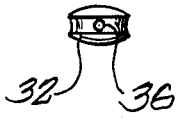
FIGS. 5 and 6 are top and side views, respectively, of the clasp of the earrings.
Figure 6:
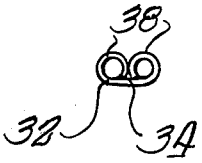

As best shown in FIGS. 4–6, the earrings 16 are of the type that are generally referred to as "pierced earrings" and have a decorative portion 28 and a post or stem portion 30 which fits through the ear of the wearer and a clasp 32 is attached to the post 30 to hold the earring on the wearer. As is best shown in FIGS. 5 and 6, the clasp 32 is preferably made of a resilient metallic material and is preferably constructed of one piece, having a central portion 34 having an aperture 36 therein, the central portion merging into curved opposed end portions 38 which are normally biased toward one another. Thus, the post 30 causes the end portions 36 to be spread apart from one another a small distance and the normal biasing force of the material will cause the clasp to be frictionally held upon the post. It is noted that the post may be pulled out of the clasp by merely holding the clasp, it being unnecessary to manipulate the clasp in any unusual manner. Similarly, the clasp can be applied to the post of the earring merely by placing it in the aperture 38 thereof and pushing the clasp onto the stem.

In accordance with an aspect of the present invention, the earrings 16 are adapted to be held in place on the top of the lid 14 when they are not being worn. Thus, the lid 14 is provided with a pair of apertures 40 through which the post 30 can be passed. The decorative portion 28 of the earrings 16 is on the upper side of the lid so as to be visually observable and the clasp 32 is applied to the post on the underside of the lid to hold the earrings in place. As is best shown in FIG. 1, the decorative portion 28 of the earrings greatly enhance the visual impact of the jewelry box and, in the illustrated embodiment, the decorative portion is in the shape of flowers having two or three petals that are attached to the post 30. It should be understood from the proportion of the size of the earrings relative to the size of the base and lid of the jewelry box, that the illustrated embodiment is relatively small and petite, possessing a significant degree of novelty and appeal. As previously mentioned, the hollow portion 26 of the lid 14 is provided so that the thickness of the central portion of the lid where the apertures 40 are located is not appreciably greater than a fraction of the length of the earring post 30. This permits the clasp 32 to be applied to the post after the earring has been inserted through an aperture.

In accordance with another aspect of the present invention, the top surface of the lid 14 is preferably provided with indicia 42 that is painted or otherwise applied adjacent the apertures before the material is fired. In this regard, it is preferred that porcelain be used because of its aesthetic translucent qualities. In such case, the paint is preferably a water soluble underglaze paint that is painted on the raw porcelain before it is fired. The paint is fused into the ceramic or porcelain material during the firing operation so as to be permanently engrained in the texture of the surface. The indicia 42 preferably signifies the shape and color of a stem or leaves for the flowered decorative portion 28 of the earring 16. Thus, when the earrings 16 are applied to the lid in the manner previously described and shown in FIG. 1, the overall visual appearance is one of a flower with leaves and a stem so that it provides a coordinated visual impact to the observer.

In keeping with the present invention, the base 12, lid 14 as well as the decorative portion 28 are preferably formed of a ceramic material that is made in accordance with well known techniques. Thus, the indicia 42 that is provided on the upper surface of the lid 14 can be fused into the surface of the ceramic material and will not wear off during normal use. While the embodiment illustrated incorporates decorative portions in the shape of flowers, it should be appreciated that other novel combinations could be used, such as geometric shapes in a modern or contemporary motif or novelty items to take advantage of a particular tourist attraction.

It should also be understood that while the preferred embodiment of the present invention has been described herein, various other modifications and alternatives and substitutions will become apparent to those skilled in the art, accordingly, the scope of the present invention shall be defined only by the appending claims and equivalents thereof.

Various features of the present invention are set forth in the following claims.

What is claimed is:

1. A jewelry box and earrings comprising, in combination:

a ceramic base having a cavity therein for holding jewelry and the like;

at least two earrings of the type that have a decorative portion made from a ceramic material, a generally straight post attached thereto and a removable clasp for cooperative attachment with the post; and, a ceramic lid adapted to cooperatively engage said base for covering said cavity, said lid having an aperture therein for receiving the post of each of said earrings, so that the decorative portion of the earrings are visually observable on the upper side of said lid, the associated clasp of each earring being secured to the portion of the associated post extending through the aperture on the underside of said lid, the upper surface of said lid being provided with fused indicia artistically associated with the shape of the decorative portion of each of said earrings.

2. A jewelry box as defined in claim wherein the decorative portion of each of said earrings is in the shape of a flower.

3. A jewelry box as defined in claim 2 wherein said fused indicia illustrates portions of the stem and leaves associated with the flower portion of the earrings.

4. A jewelry box as defined in claim 1 wherein said base has a generally circular top surface and said lid has a downwardly extending annular flange for engaging the sidewalls of said base when said lid is placed thereon.

5. A jewelry box as defined in claim 1 wherein said lid is generally dome shaped and has an interior cavity so that the thickness of the central portion of said lid is less than the length of the post of said earrings, thereby enabling its associated clasp to engage said post.

* * * * *